US012077343B2

(12) United States Patent
Porat et al.

(10) Patent No.: US 12,077,343 B2
(45) Date of Patent: Sep. 3, 2024

(54) SELF-CLOSING SACK

(71) Applicant: Aquabot Ltd., Afula (IL)

(72) Inventors: Joseph Zvi Porat, Highland Beach, FL (US); David Shlomo Gabrieli, Ramat Yishai (IL); Shay Gabrieli, Ramat Yishai (IL); Yigal Natan Ringart, Givat Ela (IL)

(73) Assignee: Aquabot Ltd., Afula (IL)

( * ) Notice: Subject to any disclaimer, the term of this patent is extended or adjusted under 35 U.S.C. 154(b) by 101 days.

(21) Appl. No.: 17/798,558

(22) PCT Filed: Jan. 7, 2021

(86) PCT No.: PCT/IL2021/050027
§ 371 (c)(1),
(2) Date: Aug. 10, 2022

(87) PCT Pub. No.: WO2021/161299
PCT Pub. Date: Aug. 19, 2021

(65) Prior Publication Data

US 2023/0106842 A1 Apr. 6, 2023

Related U.S. Application Data

(60) Provisional application No. 62/975,220, filed on Feb. 12, 2020.

(51) Int. Cl.
*B65D 33/16* (2006.01)
*B65D 33/24* (2006.01)

(52) U.S. Cl.
CPC ..... *B65D 33/1658* (2013.01); *B65D 33/24* (2013.01)

(58) Field of Classification Search
CPC ..... B65D 33/1658; B65D 33/24; B65D 33/30
See application file for complete search history.

(56) References Cited

U.S. PATENT DOCUMENTS

2003/0009858 A1 1/2003 Goldberg
2009/0158694 A1* 6/2009 Matheyka ..... B65B 59/005 53/468
2010/0290719 A1 11/2010 Yeager

FOREIGN PATENT DOCUMENTS

GB 2500591 A * 10/2013 ..... B65D 33/14
KR 200415022 4/2006
KR 200415022 Y1 * 4/2006
(Continued)

OTHER PUBLICATIONS

KR 200415022 English translation (Year: 2006).*
(Continued)

*Primary Examiner* — Jason L Vaughan
*Assistant Examiner* — Amanda Kreiling
(74) *Attorney, Agent, or Firm* — PEARL COHEN ZEDEK LATZER BARATZ LLP

(57) ABSTRACT

A sack includes a flexible sack body and a mouth that includes two separable lips that form a mouth opening when the lips are separated from one another, and that close the opening when the lips are adjacent to one another. Closing structure is configured to enable a separating force that is applied to the lips to separate the lips from one another to form the mouth opening, and to bring the lips adjacent to one another to close the mouth opening in the absence of the applied separating force.

5 Claims, 7 Drawing Sheets

(56) References Cited

FOREIGN PATENT DOCUMENTS

| | | |
|---|---|---|
| WO | WO99/00132 | 1/1999 |
| WO | WO2018/218101 | 11/2018 |

OTHER PUBLICATIONS

International Search Report for PCT Application No. PCT/IL2021/050027 dated Apr. 11, 2021.
International Search Report for PCT Application No. PCT/IL2020/050911 dated Aug. 19, 2020.

* cited by examiner

SELF-CLOSING SACK

CROSS-REFERENCE TO RELATED APPLICATIONS

This application is a US National Phase Application of PCT International Patent Application No. PCT/IL2021/050027 International Filing Date Jan. 7, 2021, claiming the benefit of PCT International Patent Application No. PCT/IL2020/050911 International Filing Date Aug. 19, 2020 and U.S. Provisional Application No. 62/975,220, filed Feb. 20, 2020 which are hereby incorporated by reference.

FIELD OF THE INVENTION

The present invention relates to sacks. More particularly, the present invention relates to a sack with a self-closing mechanism.

BACKGROUND OF THE INVENTION

Electronic commerce, in which items are ordered remotely via a communications network to be delivered to the location of the customer who is ordering the item, has become a growing share of the world economy. As a result, huge numbers of items are shipped from one geographic location to another. The items are often of varied types with regard to the type of product, and as to the size, shape, type of packaging material, and weight of each item.

Handling of such varied items at various points along the journey of each item from the provider to the customer may involve warehouse operators, shippers, sorting facilities, routing facilities, and other facilities or personnel. The handling may often be facilitated by placement of several such varied items into sacks. Such a sack may be sufficiently flexible to accommodate items of different sizes and shapes. After a sack is filled at each stage of the handling, the sack may be closed and loaded onto a vehicle, conveyor system, or other type of transportation for delivery to a destination. At the destination, the sack may be opened and its contents may be removed. After processing at the destination, the items that were removed from the sack may be reloaded into the same or another sack for transport to another destination, or may be delivered without reloading to a final destination (e.g., the customer) or to another intervening destination (e.g., another sorting or routing facility).

SUMMARY OF THE INVENTION

There is thus provided, in accordance with an embodiment of the invention, a sack including: a flexible sack body; a mouth of the sack body including two separable lips that form a mouth opening when the lips are separated from one another, and that close the opening when the lips are adjacent to one another; and closing structure that is configured to bow outward when a separating force is applied to the lips to separate the lips from one another to form the mouth opening, and that is configured to bring the lips adjacent to one another to close the mouth opening in the absence of the applied separating force.

Furthermore, in accordance with an embodiment of the invention, the closing structure includes at least one laterally bendable elastic bar, the bar of one lip configured to bow away from the other lip when the separating force is applied, and to straighten to bring the lips adjacent to one another when the separating force is removed.

Furthermore, in accordance with an embodiment of the invention, each of the two lips includes one of the at least one laterally bendable elastic bar.

Furthermore, in accordance with an embodiment of the invention, the bar includes a material of a group of materials consisting of: plastic, wood, composite material, and metal.

Furthermore, in accordance with an embodiment of the invention, a shape of a cross section of the rod is asymmetrical.

Furthermore, in accordance with an embodiment of the invention, the sack includes at least one pair of panels, each panel of the at least one pair of panels attached to opposite sides of the sack body, that are configured to adhere to one another when the lips are brought adjacent to one another.

Furthermore, in accordance with an embodiment of the invention, the at least one pair of panels includes cooperating panels of a hook-and-loop fastener.

Furthermore, in accordance with an embodiment of the invention, a panel of the at least one pair of panels is substantially affixed to a side of the sack body.

Furthermore, in accordance with an embodiment of the invention, at least two ends of that panel are affixed to the sack body.

Furthermore, in accordance with an embodiment of the invention, the at least two ends are stitched to the sack body.

Furthermore, in accordance with an embodiment of the invention, a panel of the at least one pair of panels includes a flap.

Furthermore, in accordance with an embodiment of the invention, one an end of the flap that is nearer to the lips with respect to another end of the flap is affixed to the sack body.

Furthermore, in accordance with an embodiment of the invention, the end affixed to the sack body is stitched, glued, or welded to the sack body.

Furthermore, in accordance with an embodiment of the invention, the at least one pair of panels includes at least two pairs of panels.

Furthermore, in accordance with an embodiment of the invention, one pair of the at least two pairs is located on the sack body interior to another pair of the at least two pairs.

Furthermore, in accordance with an embodiment of the invention, a panel of the one pair of the at least two pairs includes a flap.

Furthermore, in accordance with an embodiment of the invention, a panel of each pair of the at least two pairs includes a flap.

Furthermore, in accordance with an embodiment of the invention, the sack includes an additional opening that is provided with manual closing structure that is openable and closable by manual operation of the manual closing structure.

Furthermore, in accordance with an embodiment of the invention, the manual closing structure includes a zipper.

Furthermore, in accordance with an embodiment of the invention, the additional opening is located at an end of the sack body that is opposite the mouth.

There is further provided, in accordance with an embodiment of the present invention, a loading system including: storage structure for holding one or more self-closing sacks, each sack including a flexible sack body with two separable lips that form a mouth opening when the lips are separated from one another, and that close the opening when the lips are adjacent to one another, and closing structure that is configured to bow outward when a separating force is applied to the lips to separate the lips from one another to form the mouth opening, and that is configured to bring the lips adjacent to one another to close the mouth opening in the absence of the applied separating force; a transport mechanism to move a sack that is held by the storage structure to a loading position of the system; an opening mechanism to separate the lips of the sack that is at the loading position from one another to form the mouth opening of that sack; and loading structure to enable placement of one or more items into the formed mouth opening.

Furthermore, in accordance with an embodiment of the invention, the opening mechanism includes at least one pin that is insertable between the lips.

Furthermore, in accordance with an embodiment of the invention, an end of the at least one pin is tapered.

Furthermore, in accordance with an embodiment of the invention, the opening mechanism further includes an arm configured to pull one of the lips away from the other lip.

Furthermore, in accordance with an embodiment of the invention, the transport mechanism is further configured to remove the sack from the loading position after the placement of the one or more items into the mouth opening.

Furthermore, in accordance with an embodiment of the invention, the opening mechanism is configured to enable the closing structure to close the mouth after the placement of the one or more items into the mouth opening.

BRIEF DESCRIPTION OF THE DRAWINGS

In order for the present invention to be better understood and for its practical applications to be appreciated, the following Figures are provided and referenced hereafter. It should be noted that the Figures are given as examples only and in no way limit the scope of the invention. Like components are denoted by like reference numerals.

DETAILED DESCRIPTION OF THE INVENTION

Figure 1A:
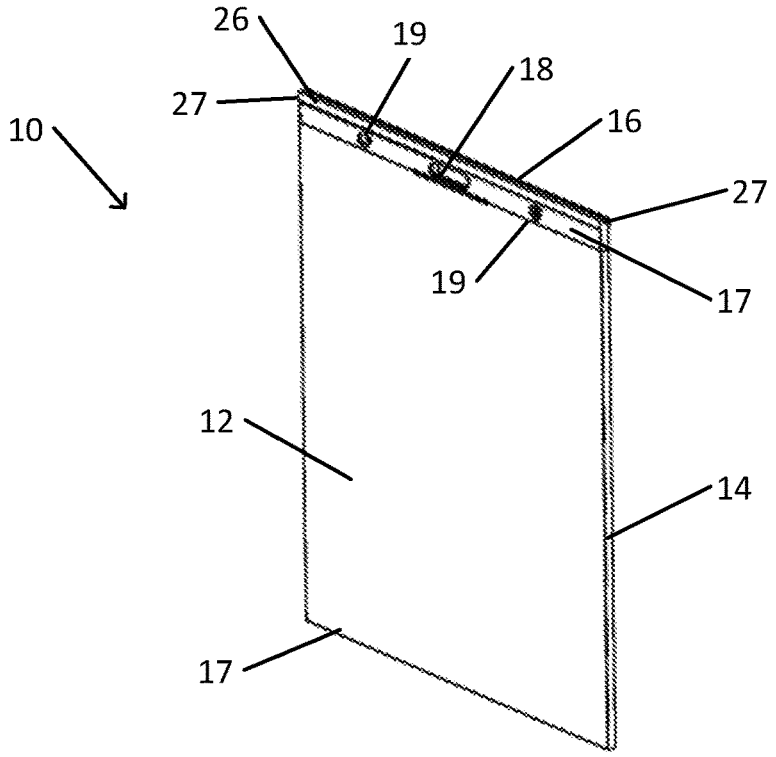
FIG. 1A schematically illustrates an example of a self-closing sack, according to some embodiments of the invention, when closed.

In the following detailed description, numerous specific details are set forth in order to provide a thorough understanding of the invention. However, it will be understood by those of ordinary skill in the art that the invention may be practiced without these specific details. In other instances, well-known methods, procedures, components, modules, units and/or circuits have not been described in detail so as not to obscure the invention.

Although embodiments of the invention are not limited in this regard, discussions utilizing terms such as, for example, "processing," "computing," "calculating," "determining," "establishing", "analyzing", "checking", or the like, may refer to operation(s) and/or process(es) of a computer, a computing platform, a computing system, or other electronic computing device, that manipulates and/or transforms data represented as physical (e.g., electronic) quantities within the computer's registers and/or memories into other data similarly represented as physical quantities within the computer's registers and/or memories or other information non-transitory storage medium (e.g., a memory) that may store instructions to perform operations and/or processes. Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. Unless explicitly stated, the method embodiments described herein are not constrained to a particular order or sequence. Additionally, some of the described method embodiments or elements thereof can occur or be performed simultaneously, at the same point in time, or concurrently. Unless otherwise indicated, the conjunction "or" as used herein is to be understood as inclusive (any or all of the stated options).

A self-closing sack (sack to be understood as referring to any type of bag, sack, basket, or other closable container that is at least partially flexible or expandable to accommodate a load), in accordance with some embodiments of the present invention, includes a flexible sack body with an opening generally defined by two or more (e.g., made up of multiple jointed segments) lips at an openable mouth end that are configured to self-close in the absence of a force that holds the lips open. For example, the lips may each include an elastic bar or strip that has an initial substantially linear form, but would curve outward (away from one another) when outward pulling or pushing forces are applied to the opposite ends of the strip. The ends of the bars are typically connected or hinged to one another so as to prevent the ends of the bars from separating from one another when the lips are opened.

Typically, each bar is asymmetrically constructed such that a laterally applied separating force may cause the bars to bow laterally outward away from one another, while the bar resists bending in other directions (e.g., so as to impede bowing of the bar into the interior of the sack body, or outward away from the sack body. Thus, the stiffness (or bending or flexural modulus) of the bar is greater in the longitudinal direction (e.g., a dimension that extends generally from the mouth of the sack to the bottom of the sack) than in the lateral direction (e.g., along a dimension that lies approximately in the plane of the mouth of the sack when the sack is opened).

Typically, adjacent ends of the lips are inseparably (e.g., without damaging the mouth of the sack) connected. When the sack is closed, the lips lie adjacent to one another such that the entire, or a majority of the length of each lip abuts the other lip. In the typical case of two lips, the ends of each lip are connected to the ends of the other lip. The lips may be separated from one another by application of a separating force (e.g., by applying pressure in opposite directions at the joined ends of the lips) to reveal the opening of the sack. The lips are configured to return to the closed state in which the lips are adjacent to one another when the separating force is removed. The lips are configured to remain in the closed state when no separating force is applied.

A body of the sack may be formed of a flexible (and, typically, inelastic) material that may conform to the shape of items that are placed within the body of the sack. Typical materials for forming the body of the sack may include cloth (e.g., of natural fiber, or of a mesh of plastic or metallic wires), plastic sheeting (e.g., including air holes or valves to enable escape of air from the sack to enable compact storage of the sacks), or another suitable flexible material. The material of a body of a particular sack may be selected to have a thickness or tear resistance that is suitable for holding the types of items that are expected to be placed into that sack. For example, the material may be selected to resist or withstand tearing with items within a particular range of weights and shapes (e.g., whether with rounded or sharp corners) of items that are put into that sack under expected handling conditions. Similarly, the maximum size of the mouth opening, as well as the size of the sack body, may be designed to accommodate an expected quantity, shape, and size of items that are to be placed into the sack.

Typically, the lips include self-closing structure that causes the lips on opposite sides of the mouth opening to move toward one another when a force that was previously holding the lips apart (e.g., to enable filling or emptying of the sack) is released. In addition, the lips include locking structure that causes the lips to adhere to one another after they meet after closing. Thus, the locking structure may impede or prevent separation of the lips from one another until a deliberate separating force is applied to the lips in order to open the mouth.

For example, the lips of the self-closing sack may be configured to lie flat adjacent to one another when the mouth of the self-closing sack is closed. In this case, the self-closing structure may include an elastic bar that may be bowed or bent outward to acquire an arched form whose concave side faces the other lip. The mouth opening may thus be formed in the space that is formed between the outwardly bent lips.

For example, a separating force may be applied to the lips to cause the lips to bend so as to bulge or bow outward away from one another. The separating force may be applied to or near a central region the lips between the ends at which the lips are connected to one another. The separating force may be a pulling force that is applied to the outward-facing side (e.g., facing away from the opposite lip) of the lips, or a pushing force that is applied to the inward-facing sides of the lips (e.g., facing toward the opposite lip). Thus, an opening may form at a mouth end of the sack. The opening may enable introduction of items into the interior of the sack body, or removal of items from the sack.

When the separating force is released, the elasticity of the bar may cause the bar to relax to return to its unbent (e.g., straight) shape. Thus, after the release of the outward bending force, the lips may straighten so that the two lips lie parallel to and adjacent to one another. Thus, the opening at the mouth end of the sack may be closed.

Alternatively or in addition, one or both of the lips may be flexible (and not necessarily elastic) and include magnets that are configured to attract one another. Alternatively, one of the lips may include magnets, while the other lip includes strips or pieces of a ferromagnetic material. Thus, the magnets may apply an attractive force to pull the lips toward one another in the absence of a separating force. As another example, the lips may include an elastic belt or band that closes the mouth end of the sack, but which may be stretched to form an opening to enable access to the interior of the sack body.

The locking structure includes two cooperating panels, each at least partially attached to different lips of the mouth opening of the self-closing sack.

For example, the locking structure may include cooperating hook-and-loop fasteners on opposite lips of the mouth of the self-closing sack. The hook-and-loop fasteners are arranged such that the fastener is fastened when the lips are closed. Alternatively or in addition, the locking structure may include cooperating panels or strips of magnetic locking structure (e.g., two cooperating magnetic panels on opposite lips with magnetic polarizations to enable the panels to attract one another when the lips are brought together, or a magnetized panel on one lip and a ferromagnetic panel on the opposite lip), adhesive locking structure, or other mechanical latching structure.

One panel of the locking structure may, in some examples, be mounted on a flap. One end of the flap (typically an end of the flap that is nearer to the lips than other ends of the flap) is fastened to the lip at the mouth opening of the self-closing sack. For example, the fastened end of the flap may be sewn, stitched, riveted, bolted, stapled, bonded, glued, welded, or otherwise permanently affixed to the lip (e.g., at an interior edge of the closing structure), or to the sack body near or adjacent to the lip. The remainder of the flap, e.g., that extends interiorly into the sack body from the fastened end, is free to fold or move away from the lip and the side of the sack body. The other panel of the locking structure may be completed fastened to the opposite lip (to the lip to which an end of the flap is attached) and to a part of the side of the sack body that is adjacent to the opposite lip.

For example, one panel with a cooperating component of a hook-and-loop fastener (e.g., a panel of hooks or of loops) may be located on a surface of a flap that is attached to one of the lips, while the other panel with a cooperating component of the hook-and-loop fastener (e.g., a panel of loops or hooks, respectively) may be located on the opposite lip and on a region of the sack body that is adjacent to the opposite lip.

Placement of a panel of a hook-and-loop fastener or of other locking structure on a flap may facilitate holding the mouth opening closed when the self-closing sack has been filled. Typically, prior to filling the self-closing sack and when the sack is held upright with the sack mouth upward by the lips, opposite sides of the sack body hang downward from the opposite lips. Thus, the opposite sides may hang approximately parallel to, and adjacent to one another. Typically, when the sack is filled, the flexible sides of the sack body may bulge outward. The outward bulging, when the self-closing sack is held upright by the lips, may bend or fold regions on the opposite sides of the sack body, and that are adjacent to the opposite lips, away from one another toward the horizontal. For example, in an extreme case, regions of the sides of the sack body may extend horizontally outward from the opposite lips. The outward bulging may exert an outward force on the lips, e.g., via the outwardly bent sides of the sack body that are adjacent to the lips, that may tend to separate the lips from one another.

When a panel of the elements of the locking structure is mounted on a flap that is free to move away from the interior side of the sack body, when the lips are closed the panel on the flap and a cooperating fixed panel that is attached to the opposite side of the sack body may meet and attach to one another. For example, a hook or loop panel of a hook-and-loop fastener that is mounted on a flap may attach to a fixed loop or hook panel, respectively, that is attached to the opposite side of the sack body. After attachment of the flap panel to the fixed panel, both panels are attached to the side of the sack body. When the bulging of the sack bends the side of the sack toward the lip (e.g., upward toward the horizontal when the sack is upright), the interface between the panels is rotated to become more parallel to a separating force that tends to separate the lips from one another. Thus, the separating force may exert a shearing force on the interface. In many cases, the attachment of panels of the locking structure to one another is more resistant to a shearing force than to a transverse (peeling) force that directly acts to separate the panels from one another. On the other hand, applying an outside separation force to separate the lips from one another may peel the attached panels from one another without unduly impeding opening of the sack mouth.

Furthermore, mounting one of the panels on a flap may enable the area of contact between the panels when the sack body bulges outward to be larger than would be possible if both panels were fixed to the lip or to sides of the sack body.

In some examples of a self-closing sack, the locking structure may include one or more additional pairs of cooperating panels in which the panels of each pair are configured to adhere to one another when the lips are closed by being brought adjacent to one another. For example, an additional locking structure may be mounted inward of (e.g., away from the lip and toward the interior of the sack body) locking structure that is attached at or to the lips. One or both panels of the additional locking structure may also be mounted on a flap.

In some cases, the self-closing sack may be provided with a second opening in addition to the self-closing mouth. For example, the second opening may be located at the bottom of the sack body (when the self-closing sack is held upright with the self-closing mouth at the top), opposite the self-closing mouth, or elsewhere (e.g., on a side of the sack). The second opening may include a manual closing structure that must be opened prior to accessing the interior of the self-closing sack, e.g., for unloading items from the sack body. Similarly, the manual closing structure must be manually closed when items are to be retained within the self-closing sack. For example, the manual closing structure may include a zipper, lacing, or other structure that must be manually closed (e.g., with no self closing or self locking).

For example, the second opening may be utilized to empty the contents of the self-closing sack while the self-closing sack is held upright (e.g., by handles on the lips of the sack). Such gravity-assisted emptying via the second opening, with the items simply falling out of the sack, may be more efficient (e.g., requiring less time and effort) than removing the items via the mouth of the sack. Such removal via the mouth may require reaching into the sack to remove items (e.g., by a robotic arm or by a human attendant), or inverting the sack, as well as continual application of a force to overcome the self-closing structure in order to keep the mouth open.

A loading system for automatically loading items into a self-closing sack may include storage structure for storing one or more stored self-closing sacks, a transport structure or a mechanism for moving one of stored self-closing sacks to a loading position of the loading system, an opening mechanism for opening a self-closing sack that has been moved to the loading position, loading structure for loading one or more items into the opened self-closing sack, and a removal mechanism for removing a loaded self-closing sack from the loading system (e.g., for further handling).

Storage structure may enable storage of empty self-closing sacks for filling by the loading system in a vertical stack (e.g., in a drawer or cartridge) or in a horizontal arrangement (e.g., on one or more straight rods or bars, on a circular carousel, in a cartridge, or otherwise), or otherwise. In one embodiment, the storage structure includes a cart or trolley that is removable from the loading system (e.g., from a frame of the loading system) in order to fill the trolley with empty self-closing sacks onto rods from which the self-closing sacks are suspended. After filling the trolley with self-closing sacks, the trolley may be reinserted into the loading system. For example, the trolley may be provided with casters to enable the trolley be moved across a floor, may be mounted onto a track along which the trolley may roll or slide, or may be otherwise removable and replaceable. Other types of storage structure for suspending or otherwise holding the empty self-closing sacks may include hooks, clamps, suction, or other mechanical or electromagnetic structure for holding empty self-closing sacks.

Moving structure may be configured to push or pull along a rod or track, rotate on a carousel, lift, or otherwise move one or more self-closing sacks to a loading position within the loading system. One or more sensors may be provided to detect when a self-closing sack has been moved to the loading position. In one embodiment, pushing structure may push a row of suspended self-closing sacks along a rod until the front self-closing sack of the row encounters stopping structured that prevents further advance along the rod.

When a self-closing sack has been moved to the loading position, the opening mechanism may be operated to separate the self-closing lips of that self-closing sack from one another. For example, a tapered, pointed, or wedge-like pin or rod may be inserted between the lips to overcome the closing structure of the self-closing sack. After separation between the lips, one of the lips may be pulled away from the other until a sufficiently wide mouth is opened. In other examples, hooks, suction, or other structure may be utilized to separate the self-closing lips.

Loading structure may include a chute, arm, hoist, or other mechanism for inserting items into the opened mouth of the self-closing sack. The loading structure may be constructed so as to ensure correct loading of items into the self-closing sack. A controller of the loading system may be configured to restrict loading of items into a single self-closing sack to an amount of items that may be securely retained within the sack. For example, relevant properties of each item (e.g., weight, dimensions, shape, orientation, fragility of contents, or other properties) may be determined by the controller either by reading a label on each item (e.g., placed at a location where the item is manufactured or packaged) or by sensors that measure the relevant properties.

After loading, the opening structure may be operated to release one or more of the self-closing lips, or move the lips toward one another, to enable the self-closing structure to securely close the lips of the self-closing sack.

The removal mechanism may detach the loaded self-closing sack from the loading system. For example, a pushing or pulling mechanism may cause the loaded sack to slide off of an end of a suspending rod or track to fall into a bin or onto a surface. In other examples, a loaded self-closing sack may be lifted out of the loading system for placement into or onto an appropriate bin or surface.

A self-closing sack as described herein may be advantageous over other types of sacks where many sacks must be filled and sorted quickly. For example, some facilities may sort items for shipping using tens of sorting machines each outputting about ten items per minute, for a total rate of hundreds of items per minute. When each sack into which the sorted items are placed must be opened and closed manually, each sorting machine may require about 20 workers per sorting machine to handle opening and closing of the sacks, or thousands of workers per facility. Human error may cause problems that require halting the sorting process, and to injury in some cases. On the other hand, a self-closing sack in accordance with an embodiment of the present invention, e.g., as used with a loading system as described herein, may result in a significant reduction of human intervention (e.g., as much as 80%) in the sorting process, significantly improving the efficiency of the sorting process.

Figure 1B:
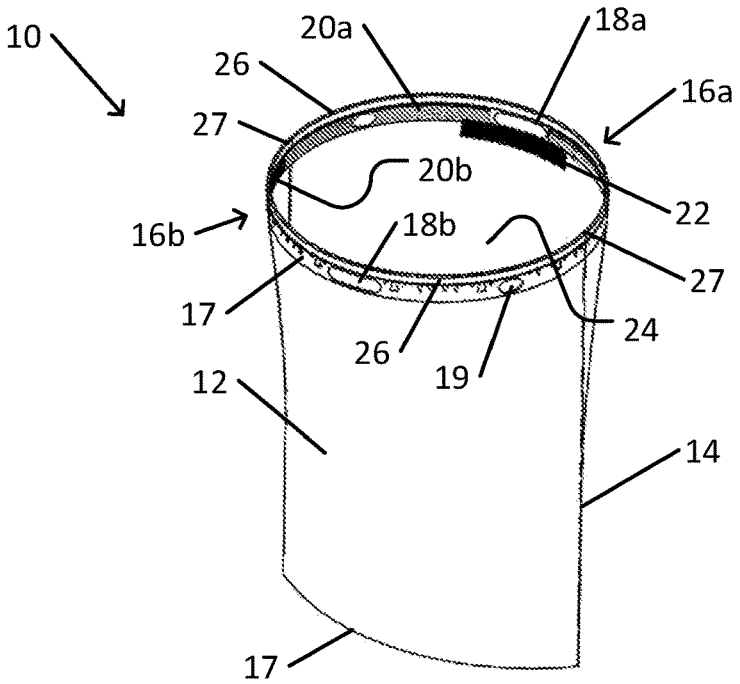
FIG. 1B schematically illustrates the self-closing sack shown in FIG. 1A when opened.

FIG. 1A schematically illustrates an example of a self-closing sack when closed. FIG. 1B schematically illustrates the self-closing sack shown in FIG. 1A when opened.

Self-closing sack 10 includes a flexible sack body 12 and self-closing lips 16. Lips 16*a* and 16*b* may be separated from one another to form mouth opening 24 of self-closing sack 10 (as in FIG. 1B). When a force that separates lip 16*a* from lip 16*b* is released, a self-closing mechanism of self-closing lips 16 causes lips 16*a* and 16*b* to move toward one another to close mouth opening 24 (as in FIG. 1A). Typically, mouth opening 24 may have a rounded (e.g., circular or oval) shape. Mouth opening 24 may be designed to be sufficiently large to enable items that are to be placed into or removed from self-closing sack 10 to pass through mouth opening 24 without impedance.

Typically, sack body 12 is constructed out of a flexible material that is strong enough to hold one or more items that may be placed into and removed from self-closing sack 10. For example, sack body 12 may be constructed of a suitable cloth, leather, mesh, plastic, or other material. In the example shown in FIG. 1A, sack body 12 when empty may be flattened into a form with two sides that are connected at sack bottom 17 and at sack ends 14. For example, sides of sack body 12 may be stitched or otherwise permanently attached to one another at sack bottom 17 and at sack ends 14. In some cases, one or more of sack bottom 17 and sack ends 14 may represent a fold or crease in the material of sack body 12. In some cases, as described below, one or more of sack bottom 17 and sack ends 14 may include a manual (e.g., not self closing) closing mechanism (e.g., a zipper or other mechanism).

When lips 16*a* and 16*b* of self-closing lips 16 are separated from one another to open mouth opening 24, items (e.g., for shipping to another location) may be placed into self-closing sack 10, or removed from self-closing sack 10 (e.g., at a final or interim destination or station). Typically, placement of items into self-closing sack 10 causes the flexible material of sack body 12 to bend or fold to conform to the shapes and forms of the placed items. After items are placed into self-closing sack 10, the separation force may be removed, enabling the self-closing mechanism to bring lips 16*a* and 16*b* together so as to close mouth opening 24. When mouth opening 24 is closed, items that have been placed into self-closing sack 10 may be securely enclosed within self-closing sack 10 until self-closing lips 16 are opened (e.g., at a shipping destination, sorting or routing station, inspection station, or elsewhere).

Self-closing lips 16 include closing structure 26 for maintaining self-closing lips 16 in a closed state (e.g., with lips 16*a* and 16*b* adjacent to one another) when not subjected to a separating force. For example, a separating force may be applied manually by a human handler or by a device that is configured to automatically or semiautomatically (e.g., under direct control of a human operator) by an opening device. For example, a separating force may be applied to handle parts 18*a* and 18*b* of sack handle 18 or to support holes 19 of self-closing lips 16, or elsewhere on sack neck 17.

Closing structure 26 may include an elastically bendable elongated bar incorporated into each lip 16*a* or 16*b* that is straight when in its relaxed (e.g., unbent) state. In the example shown, ends of the bars of closing structure 26 are connected to one another at connection 27. Connection 27 is configured (e.g., may be hinge-like) to enable the bars of closing structure 26 to bow outward from one another when self-closing lips 16 are opened (e.g., as in FIG. 1B) For example, the elastically bendable bar may be made of a suitable bendable and elastic material that is straight when not subjected to a bending force. A shape of a cross section of the bar may be circular, oval, polygonal, rayed, or another hollow or solid shape. Typically, the cross section is asymmetrical, being longer in a longitudinal dimension (e.g., that extends from the mouth of the sack to the bottom of the sack opposite the mouth) than in a lateral dimension (e.g., that is perpendicular to the long dimension of the bar). A suitable material may include a plastic or other polymer, metal, wood, fiberglass or another composite material, or another material that can be formed into an elongated rod, bar, or strip that may bow outward when flexed but that regains its original straight form when released. Alternatively or in addition, closing structure 26 may include magnets or another mechanism to close self-closing lips 16 when no separating force is applied.

When self-closing lips 16 are closed, locking structure may secure self-closing lips 16 in the closed state to prevent accidental or unintentional opening of self-closing lips 16 and mouth opening 24. Thus, any items that are held within self-closing sack 10 may be prevented from falling out until self-closing lips 16 are deliberately opened, e.g., for removal or inspection of the enclosed items.

In the example shown, the locking structure includes locking panels 20*a* and 20*b* on sack neck 17 (interior to self-closing lips 16) that are configured to adhere to one another when lips 16*a* and 16*b* are brought into contact or close proximity to one another, e.g., by closing structure 26 or otherwise. For example, locking panels 20*a* and 20*b* may include cooperating panels or regions of hook-and-loop fasteners. Alternatively or in addition, locking panels 20*a* and 20*b* may include magnetic, adhesive, or another type of locking structure that may cause locking panels 20*a* and 20*b* to reversibly attach to one another.

In some cases, one of locking panels 20*a* and 20*b* may be mounted on a flap that enables that locking panel 20*a* or 20*b* to fold or bend away from the lip 16*a* or 16*b*, respectively, to which that locking panel 20*a* or 20*b* is attached.

In the example shown, self-closing sack 10 includes an additional locking structure that includes additional locking panel 22 that is mounted interiorly to lip 16*a* and sack neck 17. Additional locking panel 22 is configured to adhere to a cooperating additional locking panel (not visible) that is located on an opposite side of sack body 12, e.g., interiorly to lip 16*b* and locking panel 20*b*. Additional locking panel 22 may include a hook-and-loop fastener surface, or another type of structure that may attach two additional locking panels 22 together.

Figure 2A:
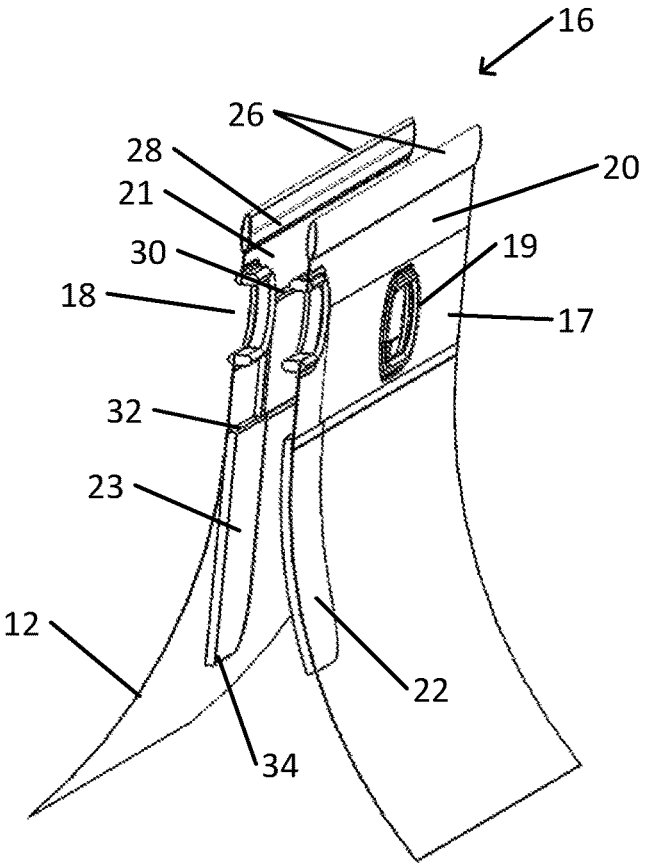
FIG. 2A is a schematic cutaway view of lips of the self-closing sack shown in FIG. 1A.
Figure 2B:
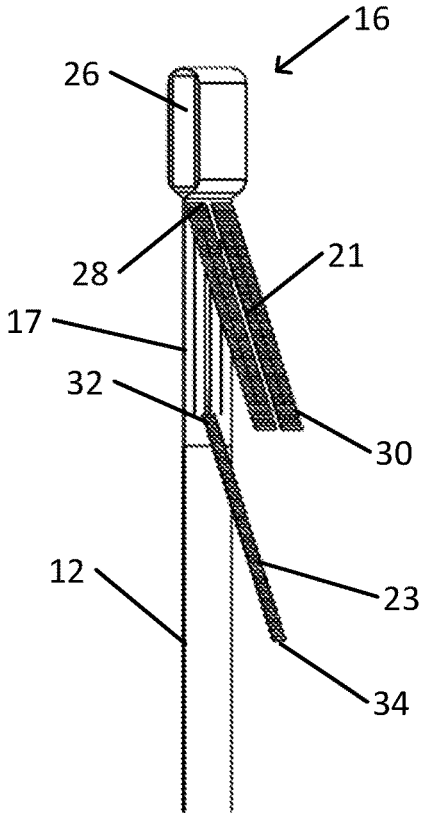
FIG. 2B schematically illustrates folding of flaps of a locking mechanism of the components shown in FIG. 2A.

One panel of locking panels 20*a* and 20*b* may be in the form of a flap with one end attached to lip 16*a* or 16*b*, respectively (e.g., such as locking panel flap 21 as shown in FIGS. 2A and 2B), while the remainder of the flap is free to separate from the sides of sack body 12. The cooperating locking panel 20*b* or 20*a*, respectively, may be fixed to the opposite side of sack body 12. For example, all sides of the cooperating locking panel 20*b* or 20*a* may be stitched, or otherwise fixed to the opposite side. Similarly, additional locking panel 22 (or the cooperating panel on the opposite side of sack body 12) may be in the form of a flap (e.g., such as additional locking panel flap 23 as shown in FIGS. 2A and 2B) with one end (e.g., an exterior end closest to self-closing lips 16) that is attached to sack body 12 while the remainder of the flap is free to separate from the sides of sack body 12. The cooperating panel may be affixed to the opposite side of sack body 12. For example, at least two different ends or edges of the cooperating panel may be stitched or otherwise affixed to the opposite side of sack body 12.

When closing structure 26 closes self-closing lips 16, cooperating locking panels 20*a* and 20*b* and additional locking panels 22 may adhere to one another. For example, a region of hook structure on one cooperating panel may mechanically engage loop structure on the other cooperating panel. As another example, a magnet on one cooperating panel may engage a ferromagnetic material or suitably polarized magnet on the other cooperating panel. When a deliberate separating force is applied to separate lip 16*a* from lip 16*b* to open mouth opening 24, the separating force that is applied may be sufficiently strong so as to overcome that adherence between the cooperating panels. On the other hand, in the absence of a deliberate separating force, the adherence force between the cooperating panels together with the closing force of self-closing lips 16 may be sufficient to hold self-closing lips 16 together during handling of self-closing sack 10.

FIG. 2A is a schematic cutaway view of lips of the self-closing sack shown in FIG. 1A. FIG. 2B schematically illustrates folding of flaps of a locking mechanism of the components shown in FIG. 2A.

In the example shown, locking panel 20, whose both upper and lower ends are connected (e.g., by stitching or otherwise) to a side of lip 16, is configured to engage locking panel flap 21 on the other side of lip 16. Locking panel flap 21 has a fixed end 28 that is affixed to sack body 12 or to a lip of self-closing lips 16. Fixed end 28 is typically an end of locking panel flap 21 that is nearest to self-closing lips 16 and mouth opening 24. For example, fixed end 28 may be affixed to sack body 12 at a point interior to (e.g., further away from self-closing lips 16 and mouth opening 24 than) closing structure 26. For example, fixed end 28 may be stitched, sewn, stapled, glued, or otherwise affixed to lip 16 or to sack body 12 near lip 16. Free end 30 of locking panel flap 21 is free to lie against sack body 12, as shown in FIG. 2A, or to separate from (e.g., fold or bend away from) sack body 12 toward the interior of sack body 12, as shown in FIG. 2B.

In other examples, two locking panels 20 are connected to opposite sides of lip 16 (e.g., both fixed to sack neck 17 without a flap).

Additional locking panel flap 23 has a fixed end 32 that is attached to sack body 12. Typically, additional locking panel flap 23 is located on the same side of sack body 12 as locking panel flap 21, such that locking panel flap 21 and additional locking panel flap 23 are located on (e.g., fixed ends 28 and 32) are located on a single side of sack body 12. In the example shown, fixed end 32 is attached to sack body 12 near the point on sack body 12 to where free end 30 of locking panel flap 21 extends when lying against sack body 12. Free end 34 of additional locking panel flap 23 is free to lie against sack body 12, as shown in FIG. 2A, or to separate from (e.g., fold or bend away from) sack body 12 toward the interior of sack body 12, as shown in FIG. 2B. Additional locking panel flap 23 may fold or bend away from sack body 12 to engage additional locking panel 22 on the other side of sack body 12.

Mounting of locking structure on a locking panel flap 21, on an additional locking panel flap 23, or on both, may impede or prevent unintentional or accidental separation of self-closing lips 16 during handling of self-closing sack 10.

Figure 3:
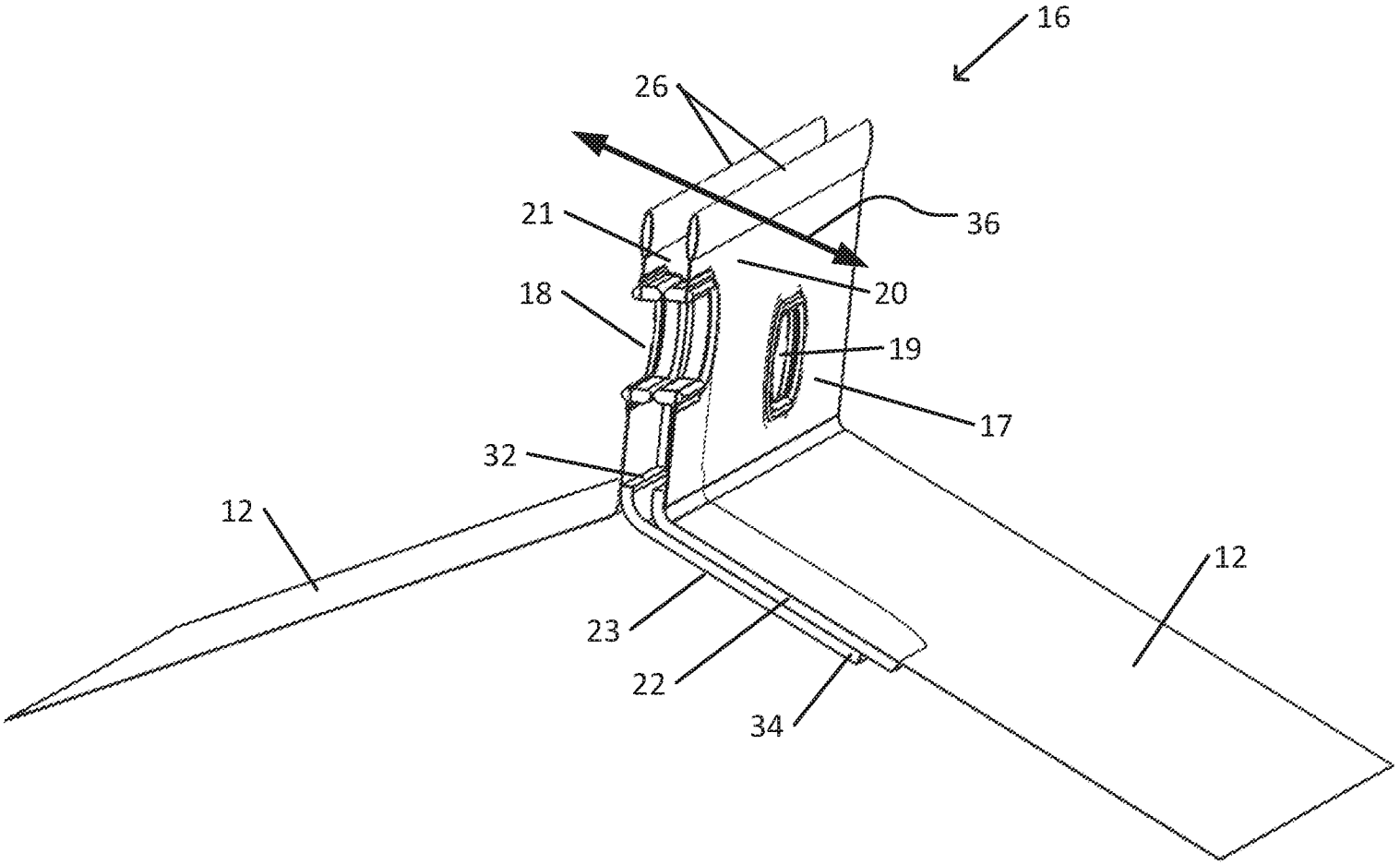
FIG. 3 schematically illustrates the locking mechanism shown in FIG. 2A when the sack is filled and its mouth closed.

FIG. 3 schematically illustrates the locking mechanism shown in FIG. 2A when the sack is filled and its mouth closed.

In the example shown, sack body 12 has bulged outward on both sides of self-closing lips 16, e.g., after self-closing sack 10 has been filled. In the schematic example shown, sack body 12 is depicted as sloping outward and downward from self-closing lips 16, e.g., when self-closing sack 10 is held upright, e.g., suspended from sack handle 18 or from support holes 19. For example, a rod may be passed through each pair of support holes 19 (e.g., on opposite self-closing lips 16) from which self-closing sack 10 may be suspended prior to, during, or after filling.

In the example shown, locking panel flap 21 (or a locking panel 20) has adhered to locking panel 20 within self-closing lips 16. Similarly, additional locking panel flap 23 has adhered to additional locking panel 22 that is fixed to the side of sack body 12. Accordingly, when sack body 12 bulges outward, additional locking panel 22 and the attached additional locking panel flap 23 bend outward (e.g., toward the horizontal when self-closing sack 10 is held upright). Thus, the adhesive interface between additional locking panel 22 and additional locking panel flap 23 is bent away from the interface between self-closing lips 16 toward perpendicularity with the interface.

When self-closing sack 10 is filled, either the weight of items that are enclosed within self-closing sack 10 or forces that are applied during handling may apply a separating force 36. Application of separating force 36 tends to open and separate between. The adhesion between one or more locking panels 20 and additional locking panels 22, as well as the bending elasticity of closing structure 26, may counter and resist separating force 36 and hold self-closing lips 16 in a closed state.

As stated above, bulging of sack body 12 may bend the adhesive interface between additional locking panel 22 and additional locking panel flap 23, to an orientation that is more parallel to separating force 36. (In some examples, the bulging may similarly bend the adhesive interface between locking panel 20 and locking panel flap 21.) In this case, separating force 36 may act to break the adhesive interface by pulling in a direction that is parallel to, or at least has a component that is parallel to, the adhesive interface. The resulting shearing countering force of the adhesive interface may be capable of resisting a separating force 36 of greater magnitude than would an adhesive interface that is oriented perpendicular to separating force 36.

When a separating force 36 is deliberately applied to self-closing lips 16, the deliberately applied separating force 36 may be strong enough to overcome the shearing countering force. Alternatively or in addition, a deliberately applied separating force 36 may applied so as to include a component that is perpendicular to the adhesive interface.

In some cases, one or more of sack bottom 17 and sack ends 14 of a self-closing sack 10 may be provided with openings that may be opened or closed by operation of manual closing structure. As used herein, manual closing structure refers to repeatedly (e.g., that does not require breaking or otherwise permanently destroying structure, e.g., by cutting or tearing, and replacement of structure when reclosing self-closing sack 10) openable and closable structure that is not self-closing, but rather requires application of a deliberate force to open or close the structure. Examples of manual closing structure included zippers, laces, buttons, snaps, latches, or other repeatedly and manually openable and closable structure.

Figure 4A:
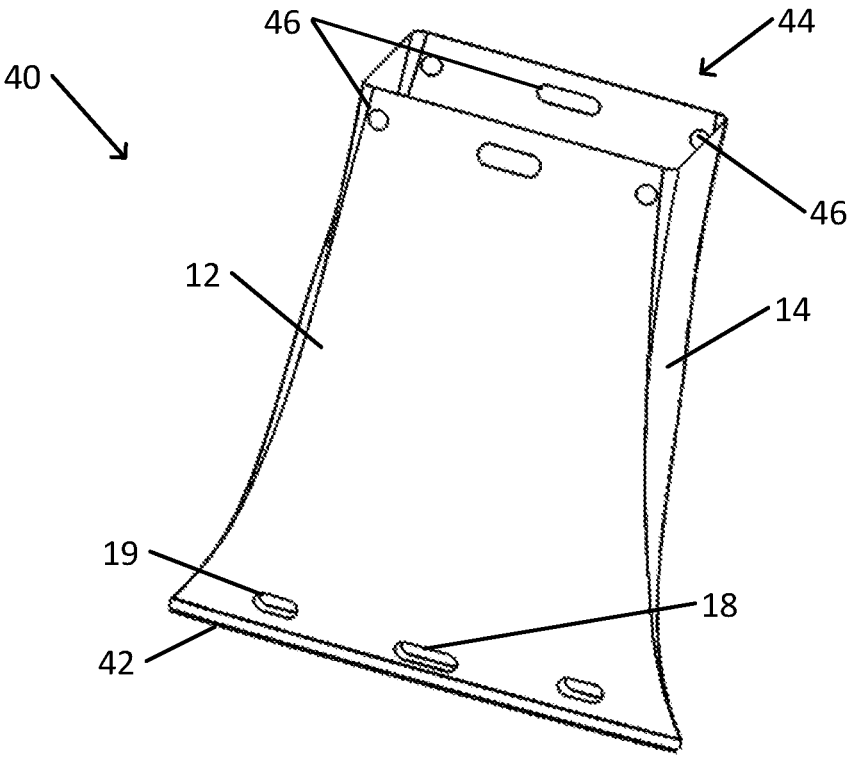
FIG. 4A schematically illustrates a self-closing sack with an additional mouth when the additional mouth is open upward.
Figure 4B:
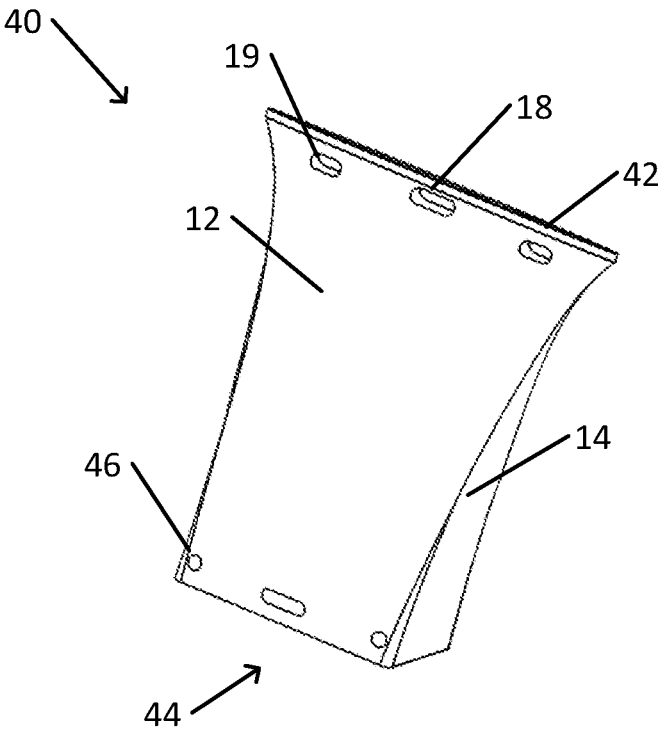
FIG. 4B schematically illustrates the self-closing sack shown in FIG. 4A with the additional mouth open downward.

FIG. 4A schematically illustrates a self-closing sack with an additional mouth when the additional mouth is open upward. FIG. 4B schematically illustrates the self-closing sack shown in FIG. 4A with the additional mouth open downward.

In the example shown, self-closing sack 40 includes manual sack opening 44. In the example shown, manual sack opening 44 is located at the bottom of self-closing sack 40, at an end that is opposite self-closing mouth opening 42. In other examples, manual sack opening 44 may be located elsewhere on sack body 12.

For example, self-closing sack 40 may be filled when manual sack opening 44 is closed and self-closing mouth opening 42 is open. For example, self-closing sack 10 may be supported by, and self-closing mouth opening 42 may be held open using, sack handle 18, support holes 19, or both. When filled, self-closing mouth opening 42 may be allowed to close, e.g., by releasing a lateral separating force from sack handle 18 or support holes 19. Self-closing sack 40 may be shipped to a destination or station, or otherwise handled, with both self-closing mouth opening 42 and manual sack opening 44 closed.

When self-closing sack 40 is to be emptied, self-closing sack 40 may be hoisted or otherwise held upright using sack handle 18, support holes 19, or both, e.g., such that manual sack opening 44 faces downward, as in the example of FIG. 4B, is sloping or tilted downward, or otherwise. Manual sack opening 44 may be manually opened, e.g., allowing items to drop out of self-closing sack 40. Alternatively or in addition, self-closing mouth opening 42 may be opened and items may be removed via self-closing mouth opening 42.

In accordance with an embodiment of the invention, a self-closing sack, such as self-closing sack 10 or self-closing sack 40, may be loaded by a loading system.

Figure 5A:
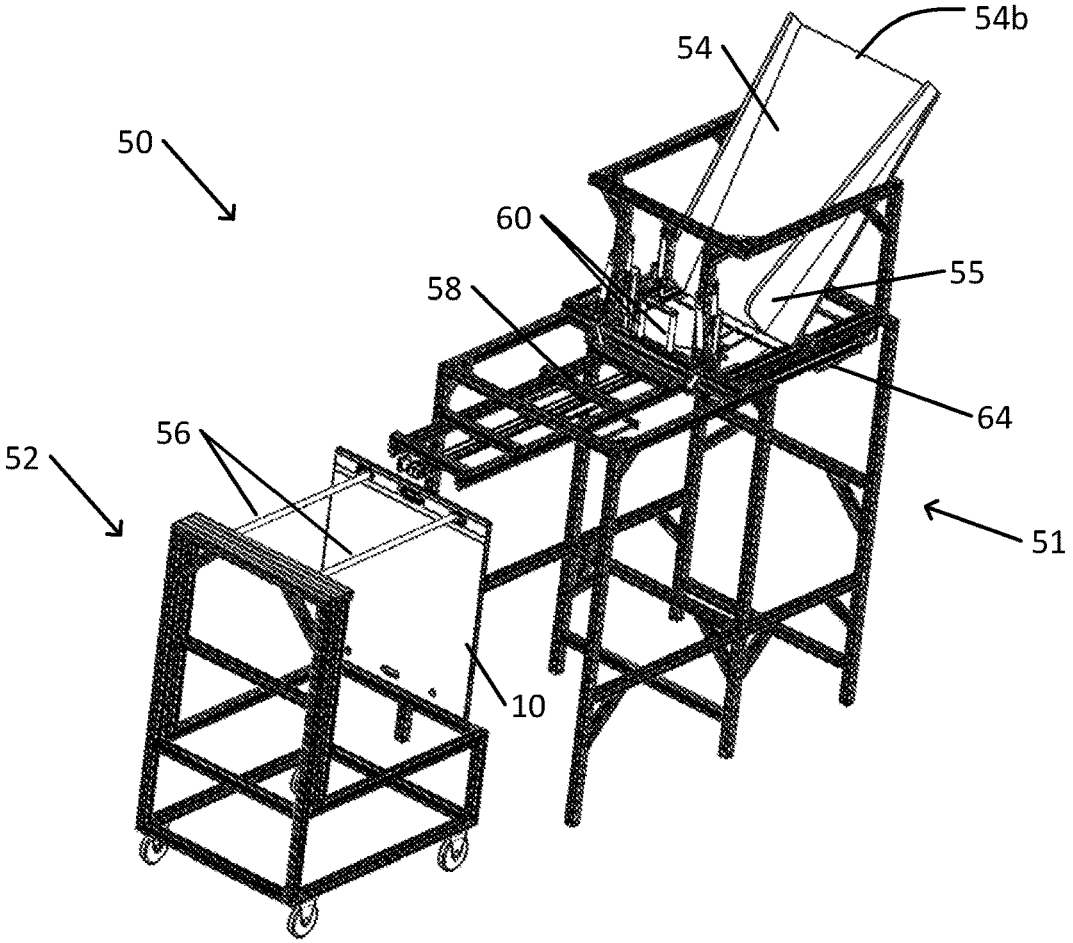
FIG. 5A schematically illustrates a loading system for loading a self-closing sack, in accordance with an embodiment of the invention.
Figure 5B:
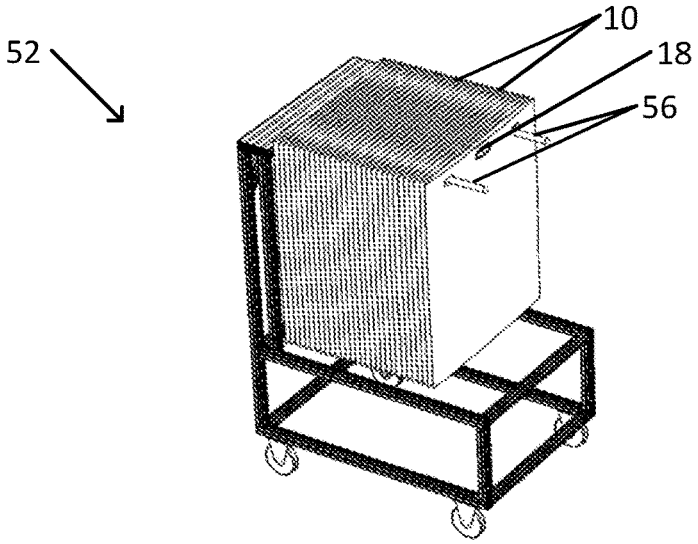
FIG. 5B schematically illustrates a loaded sack trolley of the loading system shown in FIG. 5A.

FIG. 5A schematically illustrates a loading system for loading a self-closing sack, in accordance with an embodiment of the invention. FIG. 5B schematically illustrates a loaded sack trolley of the loading system shown in FIG. 5A.

In loading system 50, one or more empty self-closing sacks 10 may be stored on a sack trolley 52. In the example shown, sack trolley 52 may be rolled away or otherwise separated from loading system frame 51 of loading system 50, e.g., for loading of additional self-closing sacks 10 onto sack trolley 52. Sack trolley 52 may be replaced into loading system frame 51, e.g., after sack trolley 52 has been loaded with empty self-closing sacks 10. In the example shown, replacement of sack trolley 52 into loading system frame 51 may include inserting distal ends of support rods 56 into sack stops 62 (visible in FIG. 6) of loading system frame 51.

In the example shown, empty self-closing sacks 10 are suspended from support rods 56 on sack trolley 52. For example, when loading a self-closing sack 10 onto sack trolley 52, each support hole 19 of each self-closing sack 10 may be placed onto one of support rods 56. In other examples, a loading system may include a circular carousel, or other system for holding one or more self-closing sacks 10. For example, a circular carousel may include a plurality of pairs of radially oriented support rods 56, where each pair of support rods 56 is capable of holding a plurality of self-closing sacks 10. Thus, when all of the self-closing sacks 10 that are held by one pair of support rods 56 have been filled, the carousel may be rotated to enable filling of the self-closing sacks 10 that are held by another pair of support rods 56.

Loading system 50 is configured to open a single self-closing sack 10 of the self-closing sacks 10 that are loaded onto sack trolley 52. The opened self-closing sack 10 is located below loading chute 54. Thus, items to be placed into the opened self-closing sack 10 may be slid down loading chute 54 into the opened self-closing sack 10. Walls 55 of loading chute 54 may assist in guiding the items into the opened self-closing sack 10, e.g., to prevent items from falling off of the sides of loading chute 54.

Pushing mechanism 58 is configured to advance one or more self-closing sacks 10 that are suspended from support rods 56 to a loading position below loading chute 54. For example, pushing mechanism 58 may be configured to advance all self-closing sacks 10 that are suspended from support rods 56 until the front self-closing sack 10, which is suspended more toward the distal ends of support rods 56 than the other suspended self-closing sacks 10, is pushed into sack stops 62. When self-closing sack 10 is pushed against sack stops 62, self-closing lips 16 of self-closing sack 10 are positioned below sack-opening pins 60.

When a front self-closing sack 10 is pushed into sack stops 62, sack-opening pins 60 may be lowered into the front self-closing sack 10.

Figure 6:
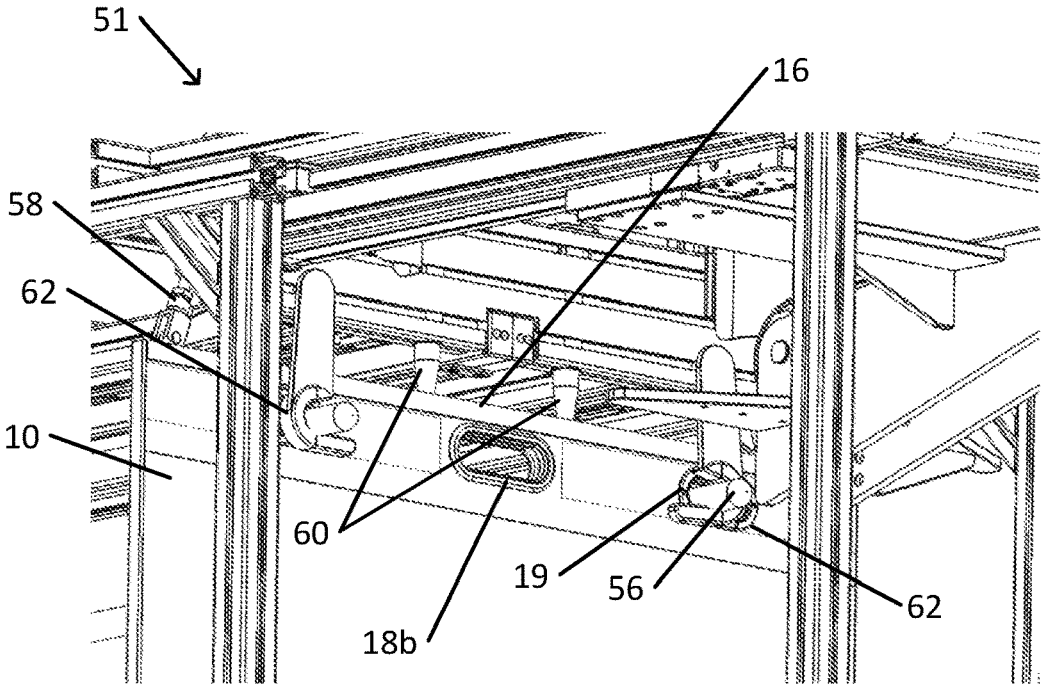
FIG. 6 schematically illustrates lowering pins of the loading system shown in FIG. 5A to open a self-closing sack.

FIG. 6 schematically illustrates lowering pins of the loading system shown in FIG. 5A to open a self-closing sack.

In the example shown, a single self-closing sack 10 that is suspended by support holes 19 from support rods 56 has been advanced distally along support rods 56 by pushing mechanism 58 until self-closing sack 10 is stopped by contact with sack stops 62. At this point, one or more sensors may indicate that self-closing sack 10 has been pushed against sack stops 62. For example, the sensors may include one or more of a contact or strain sensor that is built into sack stops 62, feedback from a motor of pushing mechanism 58, or another type of optical, acoustic, electromagnetic, mechanical, or other type of sensor.

When self-closing sack 10 has been advanced to sack stops 62, or to another predetermined loading position below sack-opening pins 60, sack-opening pins 60 may be lowered to self-closing lips 16. Typically, a distal end of each sack-opening pin 60 is tapered, pointed, wedge-shaped, or otherwise shaped to facilitate insertion of the distal end between self-closing lips 16. Thus, continued lowering of sack-opening pins 60 may separate a proximal lip of self-closing lips 16 from a distal lip.

Concurrently with, or following, separation of self-closing lips 16 from one another, sack stops 62 may be moved to enable further separate between self-closing lips 16. For example, sack stops 62 may be rotated outward, removing sack stops 62 from support rods 56. In other examples, sack stops 62 may be moved distally or otherwise moved away form self-closing sack 10.

Concurrently with, or following, removal or distancing of sack stops 62 from self-closing sack 10, sack opening mechanism 64 may be operated to further separate between self-closing lips 16 to enable filling of self-closing sack 10.

Figure 7A:
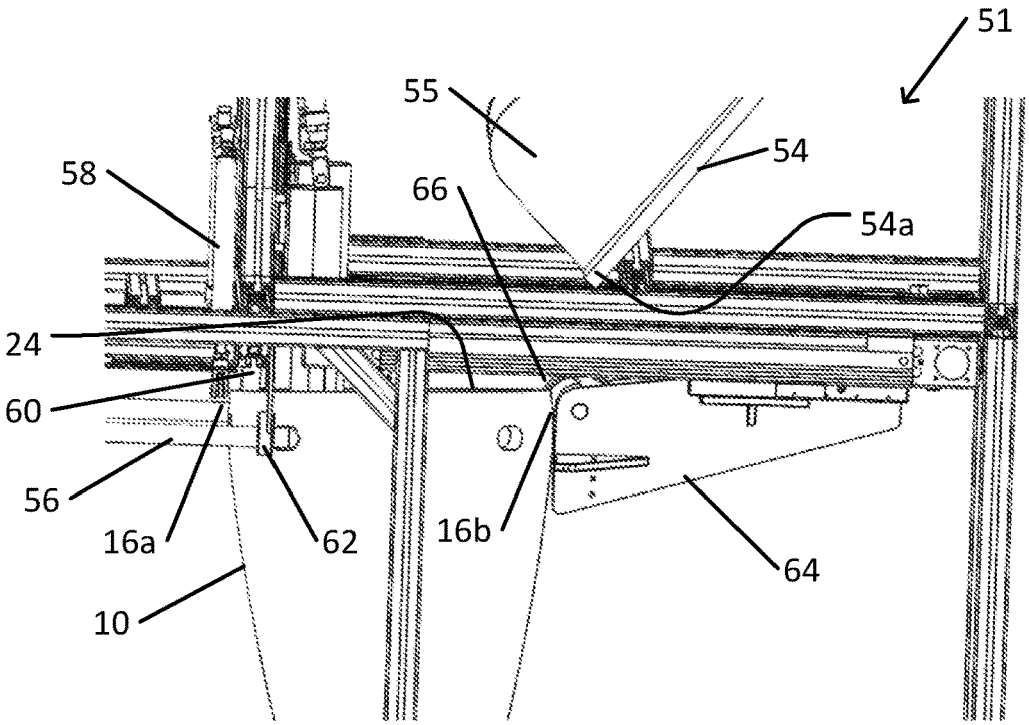
FIG. 7A schematically illustrates a side view of a self-closing sack held open by the loading system shown in FIG. 5A.
Figure 7B:
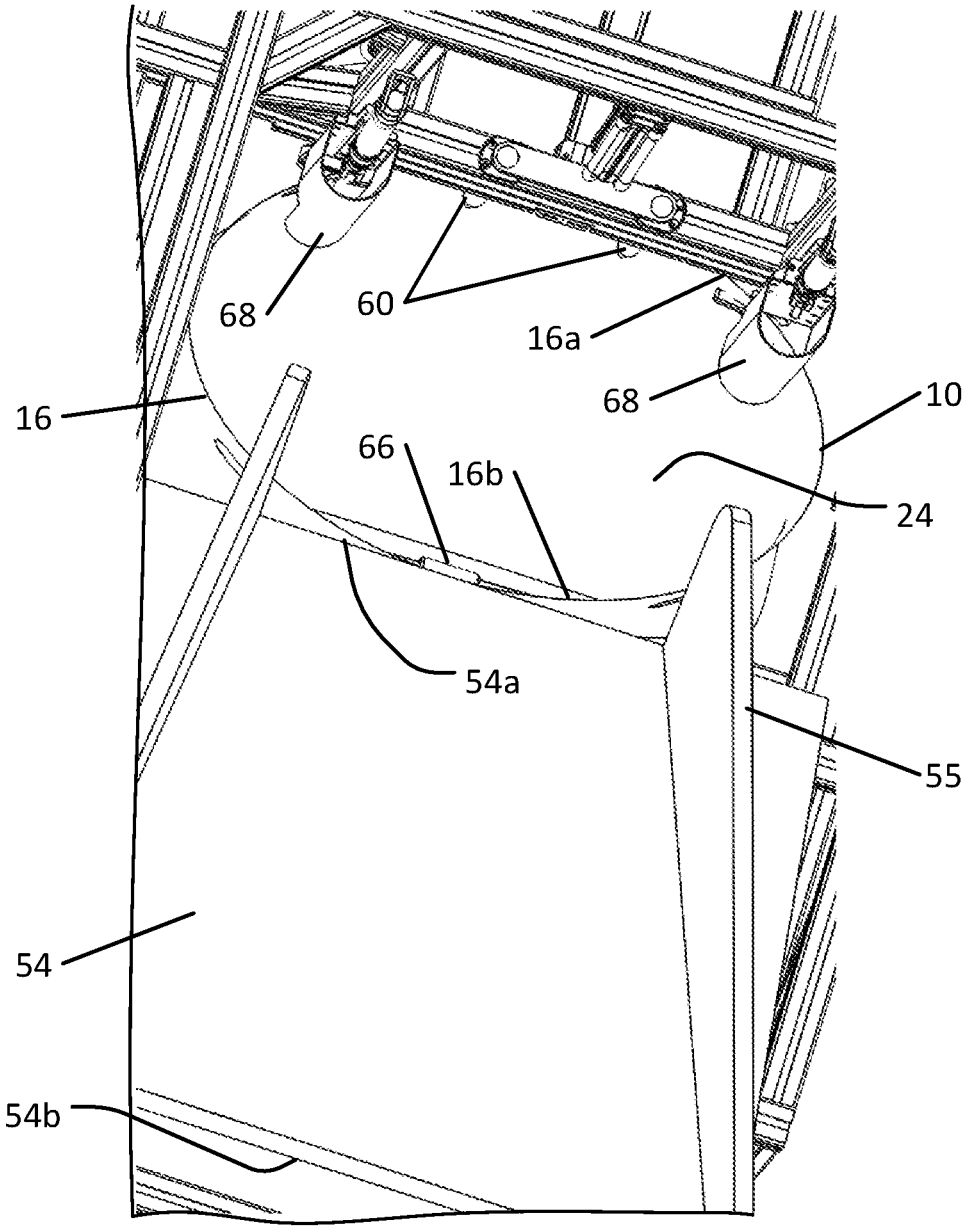
FIG. 7B shows the self-closing sack held open by the loading system, as shown in FIG. 7A, as viewed from the direction of the loading chute.

FIG. 7A schematically illustrates a side view of a self-closing sack held open by the loading system shown in FIG. 5A. FIG. 7B shows the self-closing sack held open by the loading system, as shown in FIG. 7A, as viewed from the direction of the loading chute.

After insertion of sack-opening pins 60 between proximal lip 16*a* and distal lip 16*b* of self-closing lips 16, sack opening mechanism 64 may be moved toward distal lip 16*b*. Sack opening mechanism 64 may then insert grasping arm 66 between proximal lip 16*a* and distal lip 16*b*. In some cases, grasping arm 66 may be at least partially inserted into a handle part 18*b* of sack handle 18 on distal lip 16*b*.

With grasping arm 66 inserted between proximal lip 16*a* and distal lip 16*b*, sack opening mechanism 64 may be moved distally away from sack-opening pins 60. The distal motion of sack opening mechanism 64 may cause grasping arm 66 to grasp distal lip 16*b* and pull distal lip 16*b* in a distal direction. Concurrently, sack-opening pins 60 exert a counterforce on proximal lip 16*a*, preventing distal motion of proximal lip 16*a*. Distal lips 16*b* may continue to be pulled until distal lip 16*b* is pulled to lower end 54*a* of loading chute 54. Concurrently with the distal pulling of distal lip 16*b*, shields 68 may be lowered into the space between distal lip 16*b* and proximal lip 16*a*.

The resulting further separation of distal lip 16*b* from proximal lip 16*a* opens self-closing lips 16 to form mouth opening 24. Shields 68 may assist in ensuring that mouth opening 24 is opened to the desired shape. Concurrently with, or subsequent to, distal pulling of distal lip 16*b*, sack stops 62 may be restored to their original position (e.g., rotated back to support rods 56), proximally to proximal lip 16*a*. Thus, sack stops 62 may no longer prevent distal motion of the self-closing sack 10 that is being loaded (although such distal motion may continue to be prevented by lowered sack stops 62 and shields 68), while preventing distal motion past sack stops 62 for other self-closing sacks 10 that are loaded onto sack trolley 52.

When mouth opening 24 is fully opened, one or more items may be loaded into the open self-closing sack 10. For example, an item to be loaded into self-closing sack 10 may be dropped or otherwise placed onto loading chute 54, e.g., near upper end 54*b* of loading chute 54. The item may then slide down loading chute 54 past lower end 54*a* and into mouth opening 24 of self-closing sack 10.

Structure of loading chute 54 and of loading system frame 51 may be configured to assist in guiding an item into mouth opening 24 (and prevent falling or bounding to outside of self-closing sack 10). For example, walls 55 of loading chute 54 may prevent lateral sliding off of loading chute 54. Similarly, shields 68 on loading system frame 51 may prevent an item from flying off of loading chute 54 and hitting opened self-closing lips 16 or other structure, thus damaging the item or self-closing sack 10, or bouncing away from self-closing sack 10.

After self-closing sack 10 has been loaded, shields 68 and may be raised out of mouth opening 24 while sack opening mechanism 64 is moved proximally back toward proximal lip 16*a* while grasping arm 66 continues to grasp distal lip 16*b*. The proximal motion enables the closing structure of self-closing lips 16 to close mouth opening 24 until self-closing lips 16 are closed. When self-closing lips 16 are completely closed, sack opening mechanism 64 and grasping arm 66 may again pull distal lip 16*b*, and thus all of self-closing sack 10, distally until support holes 19 slide off of the distal ends of support rods 56. At this point, self-closing sack 10 may fall into a container or onto a surface that is located below loading system frame 51.

Other mechanisms may be utilized to store and move self-closing sacks 10 within a loading system 50 (e.g., carousel, cartridge, conveyor belt or track, or other mechanism), for opening self-closing lips 16 (e.g., application of claws, suction, or other structure), for loading items into self-closing sack 10 (e.g., robotic arm, or otherwise), and for removing self-closing sack 10 from loading system 50 (e.g., tilting, lifting out of loading system frame 51, or otherwise), or for other functionalities of loading system 50.

Different embodiments are disclosed herein. Features of certain embodiments may be combined with features of other embodiments; thus certain embodiments may be combinations of features of multiple embodiments. The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A sack comprising:

a flexible sack body;

a mouth of the sack body comprising two separable lips that form a mouth opening when the lips are separated from one another, and that close the opening when the lips are adjacent to one another: and closing structure that is configured to bow outward when a separating force is applied to the lips to separate the lips from one another to form the mouth opening, and that is configured to bring the lips adjacent to one another to dose the mouth opening in the absence of the applied separating force, wherein the sack further comprising at least one pair of panels, each panel of the at least one pair of panels attached to opposite sides of the sack body, that are configured to adhere to one another when the lips are brought adjacent to one another, wherein a panel of said at least one pair of panels is substantially affixed to a side of the sack body, wherein at least two ends of that panel are affixed to the sack body.

2. The sack of claim 1, wherein said at least two ends are stitched to the sack body.

3. A sack comprising:

a flexible sack body;

a mouth of the sack body comprising two separable lips that form a mouth opening when the lips are separated from one another, and that close the opening when the lips are adjacent to one another: and closing structure that is configured to bow outward when a separating force is applied to the lips to separate the lips from one another to form the mouth opening, and that is configured to bring the lips adjacent to one another to dose the mouth opening in the absence of the applied separating force, wherein the sack further comprising at least one pair of panels, each panel of the at least one pair of panels attached to opposite sides of the sack body, that are configured to adhere to one another when the lips are brought adjacent to one another, wherein said at least one pair of panels comprises at least two pairs of panels, wherein one pair of said at least two pairs is located on the sack body interior to another pair of said at least two pairs.

4. The sack of claim 3, wherein a panel of said one pair of said at least two pairs comprises a flap.

5. The sack of claim 4, wherein a panel of each pair of said al least two pairs comprises a flap.

* * * * *